US008261592B2

(12) United States Patent
Mehta et al.

(10) Patent No.: US 8,261,592 B2
(45) Date of Patent: Sep. 11, 2012

(54) METHOD OF PROVIDING A SOLENOID HOUSING

(75) Inventors: Shreyas R. Mehta, Scarsdale, NY (US); Hassan Cheluva Iyenger Parthasarathy, Chennai (IN)

(73) Assignee: Indimet Inc., White Plains, NY (US)

( * ) Notice: Subject to any disclaimer, the term of this patent is extended or adjusted under 35 U.S.C. 154(b) by 101 days.

(21) Appl. No.: 12/102,392

(22) Filed: Apr. 14, 2008

(65) Prior Publication Data

US 2008/0257009 A1 Oct. 23, 2008

Related U.S. Application Data

(60) Provisional application No. 60/989,649, filed on Nov. 21, 2007.

(51) Int. Cl.
*B21D 22/00* (2006.01)
*B21D 31/00* (2006.01)

(52) U.S. Cl. ..... 72/356; 72/353.2; 72/377

(58) Field of Classification Search ..... 72/352, 72/356, 358, 359, 377, 266, 267, 256, 235.1, 72/260, 264, 265, 353.2, 354.6, 355.2; 29/33 L
See application file for complete search history.

(56) References Cited

U.S. PATENT DOCUMENTS 1,410,093 A * 3/1922 Dallmeyer et al. ..... 72/356
2,350,491 A 6/1944 Butler et al.
2,400,387 A * 5/1946 Brauchler ..... 72/411
4,041,754 A * 8/1977 Otani ..... 72/356
4,217,567 A 8/1980 Roy et al.
4,365,223 A 12/1982 Fechant et al.
4,580,431 A * 4/1986 Oku et al. ..... 72/354.8
5,870,818 A * 2/1999 Bisaga ..... 29/607
5,937,692 A * 8/1999 Weyand ..... 72/356
6,029,704 A 2/2000 Kuroda et al.
6,390,929 B2 * 5/2002 Hyatt ..... 470/8
6,397,652 B1 * 6/2002 Sollami ..... 72/353.2
6,468,180 B1 * 10/2002 Okubo et al. ..... 476/40
6,731,043 B2 * 5/2004 Pritchard et al. ..... 310/265
6,908,517 B2 * 6/2005 Segal et al. ..... 148/559
2001/0025521 A1 * 10/2001 Kanamaru et al. ..... 72/356
2004/0250593 A1 * 12/2004 Takagi ..... 72/340
2005/0016246 A1 * 1/2005 Yamanaka et al. ..... 72/355.6
2005/0168310 A1 8/2005 Nickel et al.
2006/0087603 A1 4/2006 Lee

* cited by examiner

*Primary Examiner* — Edward Tolan
*Assistant Examiner* — Mohammad I Yusuf
(74) *Attorney, Agent, or Firm* — IP Attorneys Group, LLC

(57) ABSTRACT

The invention relates to a method of providing a solenoid housing, including the steps of providing a solid cylinder of malleable material having a first part and a second part; reducing a diameter of the first part of the cylinder to be less than a diameter of the second part of the cylinder; compressing the second part in an axial direction toward the first part, resulting in a flattened disc generally perpendicular to the first part; raising at least a part of a perimeter of the flattened disc in a direction toward the first part for defining a raised wall; and wherein the first part, second part, and raised perimeter are all integrally connected as a single piece.

15 Claims, 13 Drawing Sheets

METHOD OF PROVIDING A SOLENOID HOUSING

CROSS-REFERENCE TO RELATED APPLICATIONS

The present application claims priority of Indian patent application No. 848/CHE/2007 filed on Apr. 19, 2007. The present application also claims the benefit under 35 U.S.C. §119(e) of the U.S. Provisional Patent Application Ser. No. 60/989,649, filed on Nov. 21, 2007. All prior applications are herein incorporated by reference in their entirety.

FIELD OF THE INVENTION

The invention relates to a method of providing a solenoid housing.

BACKGROUND OF THE INVENTION

Solenoid housings are typically used in car control systems, such as doors, windows, hydraulic controls, engine control, and the like. Other uses include refrigerators, washers, and dryers. Further uses include electrically actuated valves/switches, door holders, speakers, and CRT monitors.

A solenoid housing is typically assembled in parts, where center pole 8 is welded or attached in any fashion to cup 12 shown in FIGS. 1*a*-1*b*, where cup 12 is usually cut from sheet metal and bent to the shape shown. Cup 12 usually starts as a flat disc cut from sheet metal and is bent upwardly around the perimeter of the disc to define a raised wall 14, or a raised lip, extending around the perimeter. Base 16 of the disc, or the part of the disc remaining flat, is usually welded or attached to pole 8.

Another way of making a solenoid housing may be to machine the various pieces in addition to or instead of assembly the pieces together. Some methods include machining at least a part of the cup or pole.

However, making a solenoid housing in the manners described above presents several disadvantages. When assembling the parts together, such as welding pole 8 to base 16, a weak point may be introduced and any mechanical failure is usually located at the junction between pole 8 and base 16.

In addition, since an electromagnetic field typically flows from pole 8 to base 16 and ultimately to raised wall 14, a bottle neck frequently occurs at the juncture of base 16 and pole 8 because base 16 is of sheet metal and its thinness provides a small cross section through which the electromagnetic field may flow. As a consequence, even though pole 8 may have a large diameter to originally permit the electromagnetic field to enter and pass downwardly toward base 16, such electromagnetic field will ordinarily be impeded once the electromagnetic field is transferred from pole 8 to base 16 on its way toward raised wall 16.

Further, one can argue the orientation of the grain structure of base 16 and raised wall 14 inhibits the flow of the electromagnetic field because the grain structure may be perpendicular or angular relative to the radially traveling electromagnetic field. Since cup 12 is usually cut from sheet metal, the orientation of the grain structure is usually not known and often is not predictable or adjustable.

With regard to machining parts of cup 12 or pole 8, such practice is normally labor intensive and usually time consuming because no more than several thousandths or hundredths of an inch may be removed at a time, and removing material at this rate often translates to long periods of time for producing a solenoid. Moreover, the lathes used for machining parts are often expensive and require a large amount of space for proper operation. Therefore, any benefits obtained from machining parts over assembling parts may be outweighed by the associated costs.

U.S. Pat. No. 4,217,567 appears in FIGS. 10 and 10A to relate to a simple soft iron plug or insert 75 with a conforming nose portion pressed as an interference fit into the external hollow space formed by the inwardly extending pole portion 52. The plug 75 has the effect of increasing the flux-carrying capacity across the gap defined by the wall 60 of the bobbin 55. Substantially the same effect may be achieved, at still lower cost, in which the flux carrying plug means comprises one or more mild steel balls 76 pressed into the hollow external cavity defined by the pole portion 52.

U.S. Pat. No. 6,029,704 Kuroda et al. appears to disclose a press formed or cold forged steel plate and a hollow cylindrical solenoid. However, because Kuroda's solenoid housing and pole is made from multiple parts and assembled, it does not efficiently conduct the electromagnetic field.

U.S. Pat. No. 4,365,223 to Fechant et al. relates to a solenoid housing that may be put together in pieces.

What is desired, therefore, is a method of making a solenoid housing that reduces weak points without sacrificing manufacturing efficiency. Another desire is a method of making a solenoid housing that enhances a flow of an electromagnetic field.

SUMMARY OF THE INVENTION

It is therefore an object of the invention to provide a method of providing a one piece solenoid housing.

Another object is a method of providing a solenoid housing that is of a solid material throughout the housing.

A further object is a method of providing a solenoid housing that forms the center pole, base, and upstanding side wall from a single, solid, electromagnetically permeable material.

Yet another object is a method of providing a solenoid housing that orients the grain structure of the material to enhance the electromagnetic permeability.

These and other objects of the invention are achieved by a method of providing a solenoid housing, including the steps of providing a solid cylinder of malleable material having a first part and a second part; reducing a diameter of the first part of the cylinder to be less than a diameter of the second part of the cylinder; compressing the second part in an axial direction toward the first part, resulting in a flattened disc generally perpendicular to the first part; raising at least a part of a perimeter of the flattened disc in a direction toward the first part for defining a raised wall; and wherein the first part, second part, and raised perimeter are all integrally connected as a single piece.

In some embodiments, the diameter of the first part is reduced by extruding the first part of the cylinder through a die. In another embodiment, the method shapes the first part and an area defined by a junction of the first part and a side of the flattened disc facing the first part.

In a further embodiment, the method includes annealing the housing after at least one of the steps of any of the following: providing a solid cylinder of malleable material having a first part and a second part; reducing a diameter of the first part of the cylinder to be less than a diameter of the second part of the cylinder; compressing the second part in an axial direction toward the first part, resulting in a flattened disc generally perpendicular to the first part; and raising at least a part of a perimeter of the flattened disc in a direction toward the first part.

In another embodiment, the method controls a cross section of the flattened disc relative to a cross section of the at least a part of a raised perimeter. In some of these embodiments, the method reduces a thickness of the raised perimeter to be less than a thickness of the flattened disc.

In a further embodiment, the method orients a plurality of grain lines of the flattened disc to be in a generally radial direction extending outwardly from a general center of the flattened disc. In some of these embodiments, the method further orients a plurality of grain lines of the first part to be in a generally axial direction extending along a length of the first part.

In another embodiment, the method includes providing a third part of the solid cylinder of malleable material on a side of the second part opposite the first part; and reducing a diameter of the third part of the cylinder to be less than the diameter of the second part by extruding the third part. In some of these embodiments, the method extrudes the third part of the cylinder through a die such that the third part has a cross sectional shape selected from the group consisting of a square, rectangle, triangle, pentagon, hexagon, octagon, polygon, and combinations thereof. In other embodiments, the method extrudes the third part of the cylinder through a die such that the diameter of the third part is different than the diameter of the first part.

In an optional embodiment, the method provides a flange at an upper part of the raised perimeter.

In another aspect of the invention, a method of providing a solenoid housing includes the steps of providing a solid cylinder of malleable material having a first part and a second part; reducing a diameter of the first part of the cylinder to be less than a diameter of the second part of the cylinder; compressing the second part in an axial direction toward the first part, resulting in a flattened disc generally perpendicular to the first part; raising at least a part of a perimeter of the flattened disc in a direction toward the first part for defining a raised wall; controlling a cross section of the flattened disc strength relative to a cross section of the at least a part of a raised perimeter; orienting a plurality of grain lines of the flattened disc to be in a radial direction extending outwardly from a general center of the flattened disc; and orienting a plurality of grain lines of the first part to be in an axial direction extending along a length of the first part.

In some embodiments, the method magnetically anneals the housing after at least one of the following steps: providing a solid cylinder of malleable material having a first part and a second part; reducing a diameter of the first part of the cylinder to be less than a diameter of the second part of the cylinder; compressing the second part in an axial direction toward the first part, resulting in a flattened disc generally perpendicular to the first part; raising at least a part of a perimeter of the flattened disc in a direction toward the first part for defining a raised wall; controlling a cross section of the flattened disc strength relative to a cross section of the at least a part of a raised perimeter; orienting a plurality of grain lines of the flattened disc to be in a radial direction extending outwardly from a general center of the flattened disc; and orienting a plurality of grain lines of the first part to be in an axial direction extending along a length of the first part.

DETAILED DESCRIPTION

Figure 2:
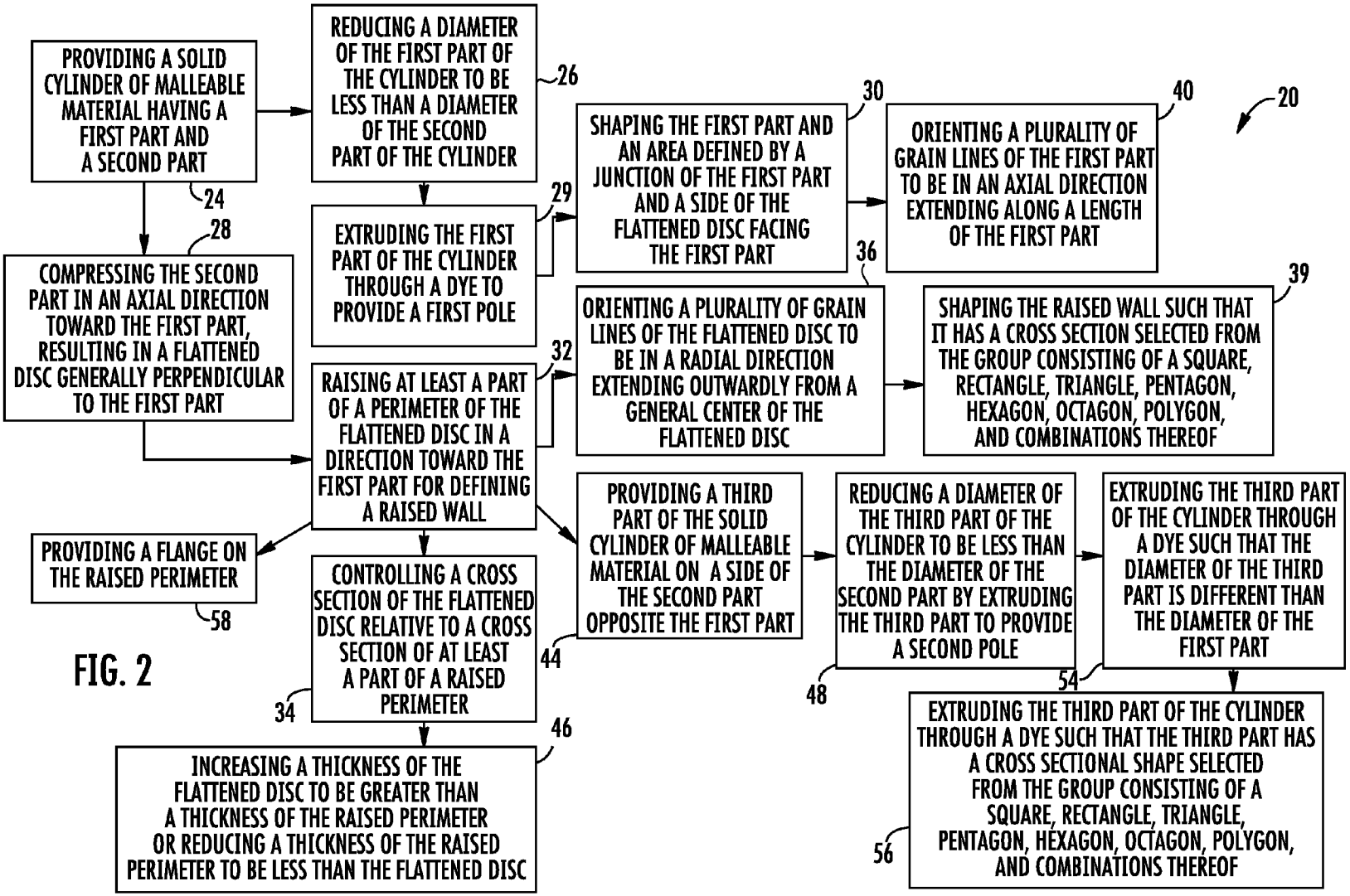
FIG. 2 depicts a method of providing a solenoid housing in accordance with the invention.

FIG. 2 depicts method 20 for providing a solenoid housing in accordance with the invention, where solenoid housing 102 (see FIG. 5*d*) is produced by method 20 from a single unit of a solid cylinder of malleable material 106. In some embodiments, material 106 is low carbon steel, such as SAE 1006, 1008, 1010, and the like.

As shown in FIG. 2, method 20 includes the steps of providing 24 a solid cylinder of malleable material having a first part and a second part, reducing 26 a diameter of the first part of the cylinder to be less than a diameter of the second part of the cylinder, and compressing 28 the second part in an axial direction toward the first part.

Figure 3A:
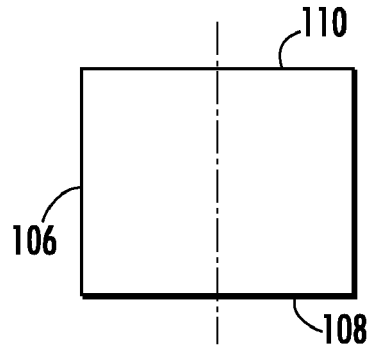
FIGS. 3*a*-3*d* more particularly depict the beginning steps of providing the solenoid housing in accordance with the method shown in FIG. 2.
Figure 3B:
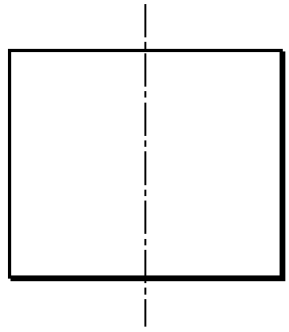
Figure 3C:
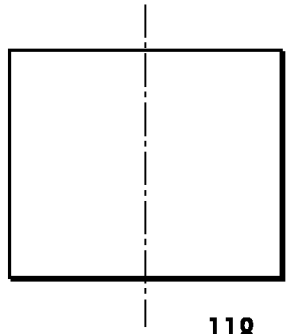
Figure 3D:
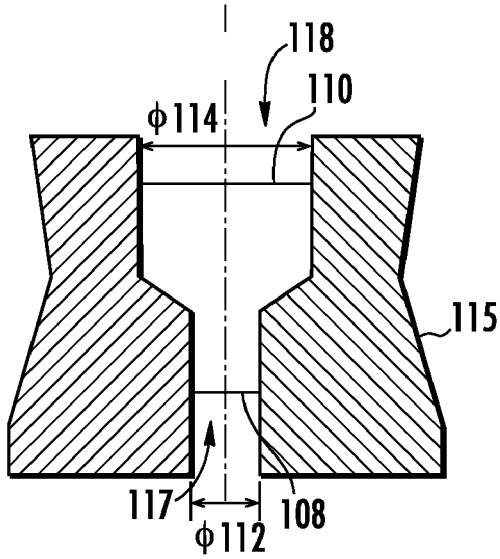

FIG. 3*a* depicts first part 108 and second part 110 of material 106 and FIG. 3*d* depicts diameter 112 of first part 108 being less than diameter 114 of second part 110 after the step of reducing diameter 112 of first part 108. First die 115 is used during the step for reducing diameter 112 by receiving material 106 where first part 108 is inserted into first die 115 in the direction of the arrow 118, wherein first part 108 is subsequently pressed into, or extruded through, orifice 117 in order to reduce diameter 112 of first part 108. Method 20 reduces the diameter of the first part by extruding 29 the first part of the cylinder through a die.

Figure 4A:
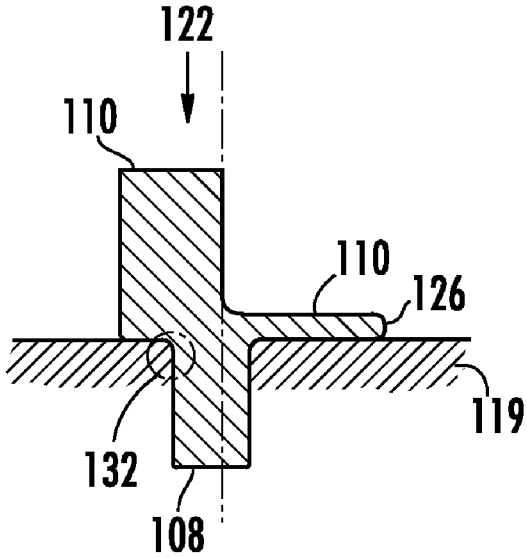
FIGS. 4*a*-4*c* more particularly depict the middle steps of providing the solenoid housing in accordance with the method shown in FIG. 2.

FIG. 4*a* shows the step of compressing 28 second part 110 in the direction of arrow 122, resulting in flattened disc 126 that is generally perpendicular to an axial passing longitudinally through first part 108. As shown, during the compressing 28 step where second part 110 is flattened into disc 126, first part 108 is securely held in place by second die 119 that is shaped with chamfers or other contours which results in the chamfers and/or contours being imparted to first part 108 after the compressing step. In other embodiments, first part 108 is held in place by first die 115. In some embodiments of method 20, method 20 includes the step of shaping 30 the first part and an area defined by a junction (item 132 of FIG. 4*a* that includes a chamfer) of the first part and a side of the flattened disc facing the first part.

Figure 4B:
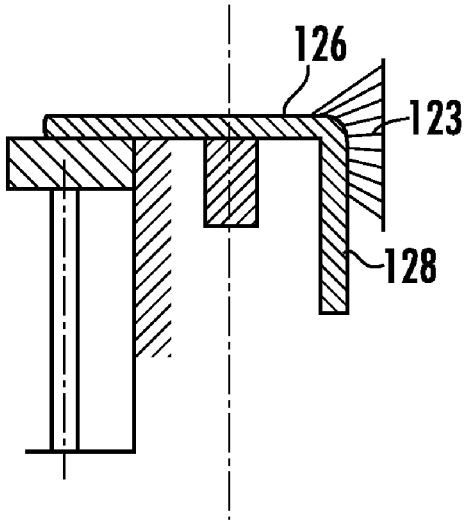

Referring to FIG. 2, method 20 also includes the step of raising 32 at least a part of a perimeter of the flattened disc in a direction toward the first part for defining a raised wall, or raised lip. FIG. 4*b* shows raised wall 128, which is shown to extend around an entire perimeter of flattened disc 126. In other embodiments, raised wall 128 extends around a part of the entire perimeter of the flattened disc 126.

Figure 4C:
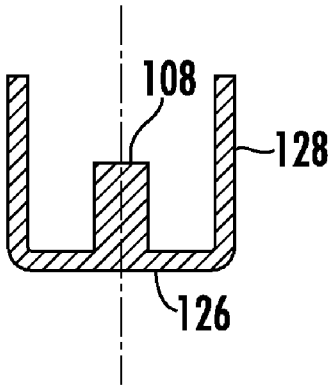

As shown in FIG. 4*b*, third die 123 is shaped to have a cavity that, when pressed downward upon flattened disc 126, bends the perimeter of disc 126 downwardly towards first part 108. While perimeter die 123 is brought down to shape raised wall 128, first part 108 is held in place by first die 115, second die 119, or another die for immobilizing first part 108 during the step of raising 32 at least part of a perimeter. FIG. 4*c* depicts the housing as it is removed from perimeter die 123, where raised wall 128 extends around the entire flattened disc 126, which is now base 134.

As described in FIGS. 3*a*-3*d*, material 106 is annealed, or stress relieved, between each step. In some embodiments, material 106 is magnetically annealed. In further embodiments, annealing is conducted between each step of method 20. Annealing is beneficial because it reduces stress introduced into material 106 during cold working, or during extruding, which occurs each time material 106 is pressed into dies, bent, or otherwise shaped. Without annealing, material 106 becomes more and more brittle after each cold working step, and material 106 becomes more and more difficult to shape in a subsequent cold working step and is more likely to crack or fail. The more often material 106 is annealed, the easier it is to extrude, or shape, material 106 in subsequent steps.

In one embodiment, annealing includes heating material 106 to approximately 850° C. and then allowing material 106 to stay at that temperature before furnace cooling material 106 to 720° C., and staying at this temperature prior to allowing material 106 to cool to room temperature.

However, costs and time involved in annealing may cause an operator to skip one or more annealing steps. In some embodiments, annealing is conducted during some of the steps set forth in FIGS. 3*a*-5*d* or in method 20, as indicated by the anneal or stress relieve instructions set forth in FIGS. 3*a*-4*c*. All that is required is for annealing to be conducted enough so that housing 102 may be provided by method 20. In further embodiments, annealing is conducted at least once during method 20 or during the steps set forth in FIGS. 3*a*-5*d*.

In a further embodiment of method 20, method includes the step of controlling 34 a cross section of the flattened disc relative to a cross section of at least a part of the raised perimeter, or raised wall. In other words, and referring to FIG. 5*a*, the cross section of base 134 is controlled to be smaller, bigger, or the same as a cross section of the raised perimeter 128. More particularly, the thickness 135 of base 134 is controlled relative to thickness 137 of raised wall 128.

As shown, the method increases 46 a thickness of the flattened disc to be greater than a thickness of the raised perimeter, or raised wall because a larger thickness 135 facilitates the flow of electricity, current, electrical energy, magnetic energy, and/or electromagnetic field as it is transmitted from pole 142 to raised wall 128. In another embodiment, method reduces 46 thickness 137 of raised perimeter to be less than thickness 135 of the flattened disc. A larger thickness 135 has more material for conducting an electromagnetic field or allowing a flow of electromagnetic energy as opposed to a thinner base 134, particularly when the electromagnetic field is to reach the outwardly located raised wall 128. As shown, raised wall 128 is made thinner than base 134 by die 125 being pressed against wall 128 in a downward and compressing motion, indicated by arrows 127, which results in thickness 137 being less than thickness 135 and wall 128 being elongated, or stretched, away from base 134.

Figure 1A:
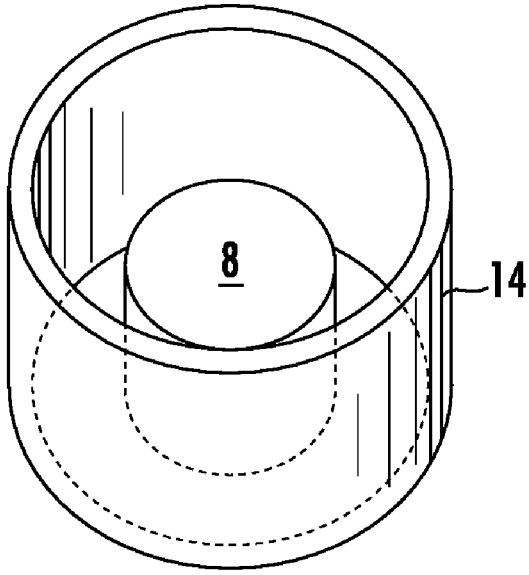
FIG. 1A (PRIOR ART)
FIGS. 1*a*-1*b* depict a solenoid housing in accordance with the prior art.
Figure 1B:
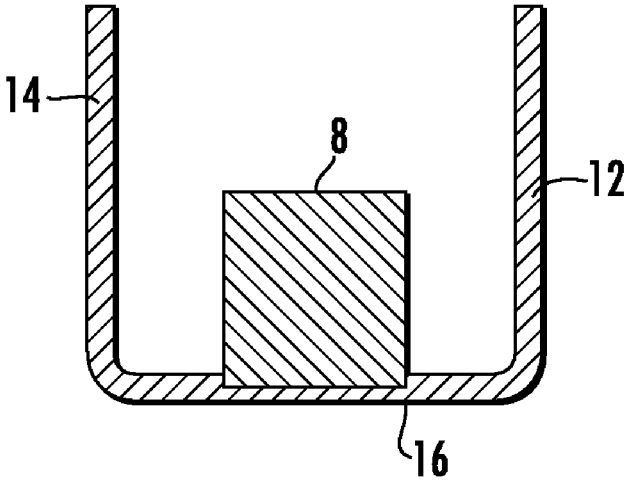
FIG. 1B (PRIOR ART)

Prior art solenoid housings made from sheet metal to form the base and raised wall that is then welded to the center pole are not able to achieve the controllability (see FIG. 1*b*.) and therefore are limited in its ability to facilitate the electromagnetic field flow from pole 142 to wall 128.

Figure 5A:
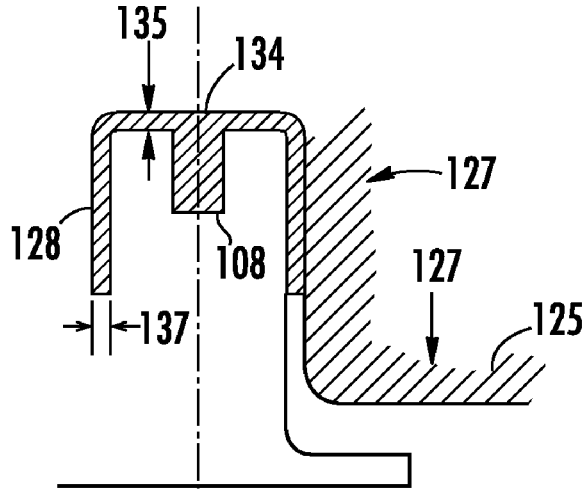
FIGS. 5*a*-5*d* more particularly depict the final steps of providing the solenoid housing in accordance with the method shown in FIG. 2.
Figure 5B:
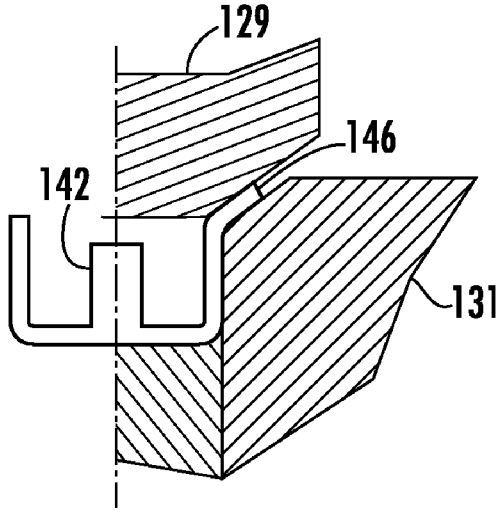
Figure 5C:
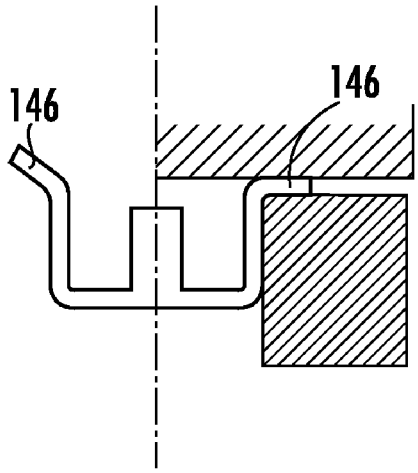
Figure 5D:
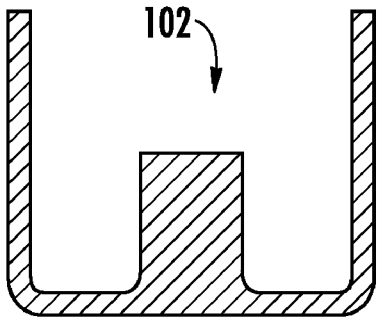

Optionally, method 20 provides 58 a flange at an upper part of the raised perimeter. Flange 146 is more particularly depicted in FIGS. 5*b*-5*c* and formed after raised perimeter 128 is placed between die 129 and 131, wherein dies 129 and 131 are subsequently rotated to bend raised perimeter 128 to a desired geometry, resulting in flange 146. FIG. 5*d* illustrates the housing 102 prior to a final magnetic annealing process.

In another embodiment and another advantage over the prior art, method 20 includes the step of orienting 36 a plurality of grain lines of flattened disc 126 to be in a generally radial direction. As stated above, the electromagnetic field is transmitted from pole 142 to raised wall 128 via flattened disc 126. In addition to controlling 34 a cross section of flattened disc, including a thickness, for facilitating transmission of the electromagnetic field through flattened disc 126, orienting 36 the plurality of grain lines of the flattened disc in a generally radial direction further facilitates transmission of the electromagnetic field because the electromagnetic field passes along the generally radial direction of the grain lines as the energy moves toward raised wall 128.

In typical prior art housings where the grain lines are not oriented, the grain lines may be oriented in a randomized, perpendicular, or angular relation relative to the travel of the electromagnetic field, in which case the grain lines inhibit the flow of the electromagnetic field rather than facilitate the flow.

Because method 20 compresses second end 110, second end 110 spreads outwardly, or the diameter of second end 110 increases in size, thereby resulting in flattened disc 126. As second end 110 spreads outwardly, the grain lines within disc 126 also moves in the outward direction and automatically orients themselves in a generally radial direction, or the outward direction in which second end 110 spreads.

Figure 6:
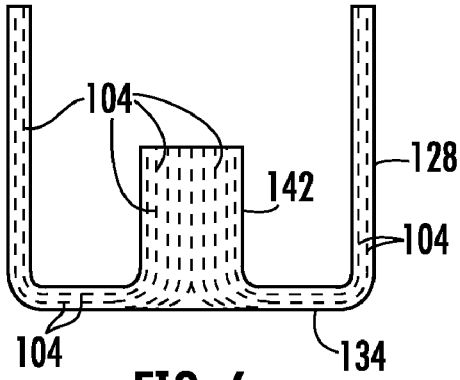
FIG. 6 depicts the solenoid housing provided in accordance with the method shown in FIG. 2.

In a further embodiment and another advantage over the prior art, method 20 includes the step of orienting 40 a plurality of grain lines of first part 108 to be in a generally axial direction extending along a length of the first part. As stated above, electromagnetic field is through a length of pole 142 to flattened disc 126. Therefore, orienting 40 the plurality of grain lines of first part 108 to be in a generally axial direction facilitates transmission of the electromagnetic field through first part 108 because the energy passes along the generally axial direction of the grain lines as the energy moves toward flattened disc 126. See FIG. 6 for an illustration of housing 102 with grain lines 104 oriented as described above.

In typical prior art housings where the grain lines are not oriented, the grain lines may be randomized, perpendicular, or angular relative to the travel of the electromagnetic field, in which case the grain lines inhibit the flow of energy rather than facilitate the flow.

Because method 20 extrudes first end 108 by pushing material 106 into first die 115 in a longitudinal direction along the length of first end 108, the grain lines within first end 108 likewise also moves in the longitudinal direction along the length of first end 108, or in the direction first end 108 is extruded.

In another embodiment, method 20 also includes the steps of providing 44 a third part of the solid cylinder of material 106 on a side of second part 110 opposite first part 108 and reducing 48 a diameter of the third part of the cylinder to be less than the diameter of the second part by extruding the third part.

Figure 7:
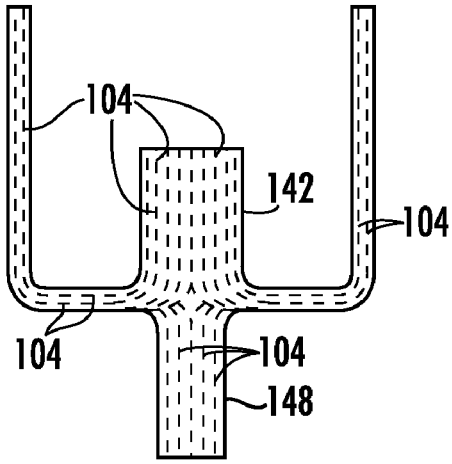
FIG. 7 more particularly depicts the alternative embodiment of providing the solenoid housing in accordance with the method shown in FIG. 2.
Figure 8A:
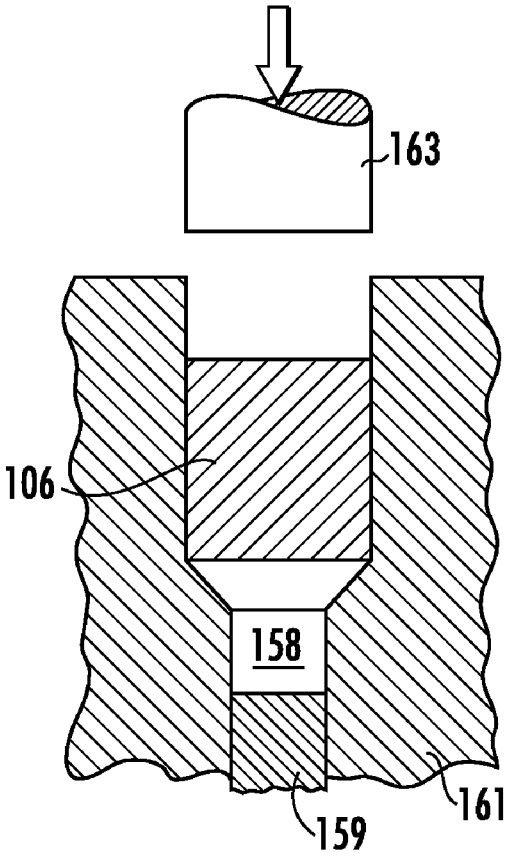
FIGS. 8*a*-8*g* depict the dies used for providing the alternative embodiment shown in FIG. 7.
Figure 8B:
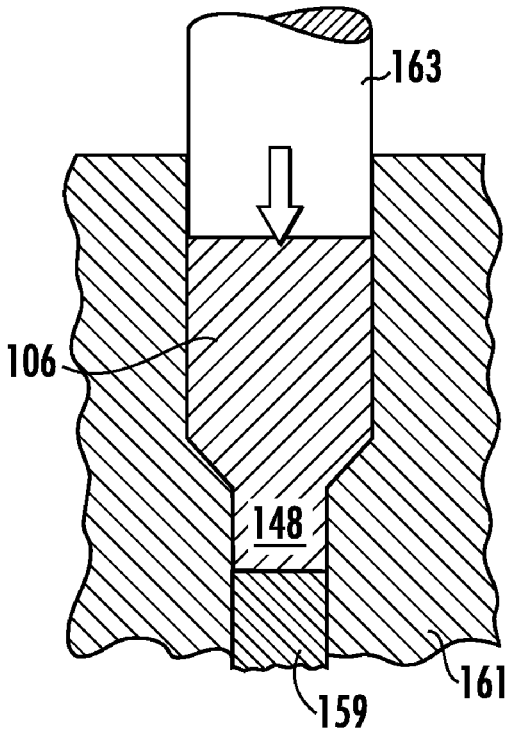

In another embodiment shown in FIG. 7, second pole 148 is provided in addition to first pole 142. As shown in FIG. 8*a*, third part or second pole 148 is obtained by extruding second part 110 through orifice 158 of die 161, where material 106 is pressed into orifice 158 by punch 163 where punch 163 fits within die 161 meet (see FIG. 8*b*). When punch 163 is removed from die 161, ejector 159 enters orifice 158 from an end opposite to material 106 and pushes material 106 out of die 161.

Figure 8C:
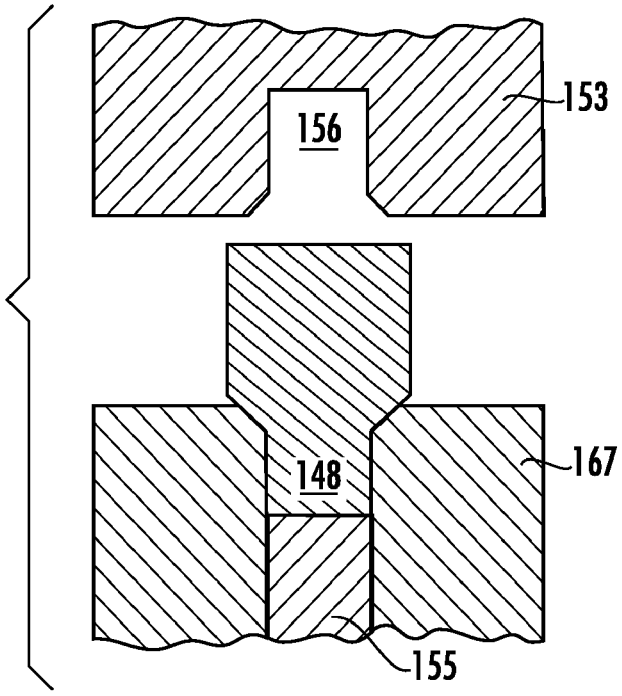
Figure 8E:
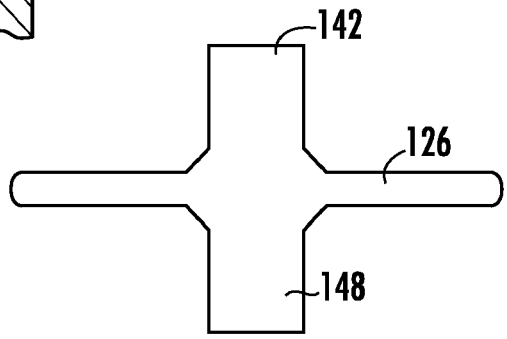
Figure 8D:
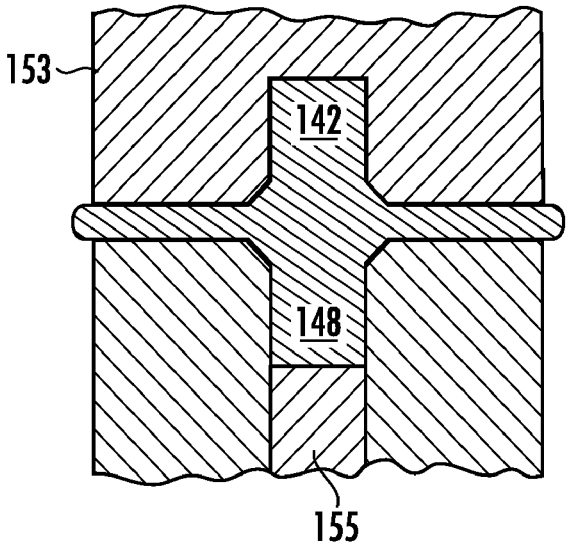

The resulting third part or second pole 148 of material 106 is then held in place within die 167 as die 153 with orifice 156 is pressed against die 167 (see FIG. 8*c*), resulting in first end 108 being extruded through orifice 156 to provide first pole 142 and flattened disc 126 (see FIGS. 8*d*-8*e*).

Once flattened disc 126 is complete, die 153 is removed and ejector 155 ejects material 106, which now includes second pole 148 provided 44 on a side of flattened disc 126 opposite first pole 142.

It is understood that poles 142, 148 may differ in diameter or shape, depending upon orifice 156, 158. As shown in FIGS. 8*a*-8*e*, the size of orifice 156 is independent from diameter 112 of first part 108 (first pole 142), where orifice 156 may be bigger, smaller, or the same diameter as diameter 112. Depending upon an operator selection, the size for orifice 156 is determined and second pole 148 is extruded 54 or pressed through die 161 such that the diameter of second pole 148 is different than diameter 112 of first pole 142.

Additionally, the shape of orifice 158 is independent from that of first pole 142 or orifice 156. In some embodiments, method extrudes 56 the third part or second pole 148 through die 161 or orifice 158 for providing second pole 148 having a cross section selected from the group consisting of a square, rectangle, triangle, pentagon, hexagon, octagon, polygon, and combinations thereof. As shown in FIGS. 9*a*-9*d*, examples of some of the resulting second pole 148 cross sections or shapes are shown, where the shapes depend upon orifice 158. It is understood that the limitations of orifice 117 and/or orifice 156 include the same limitations as orifice 158 as well as the shapes of orifice 158.

Figure 8F:
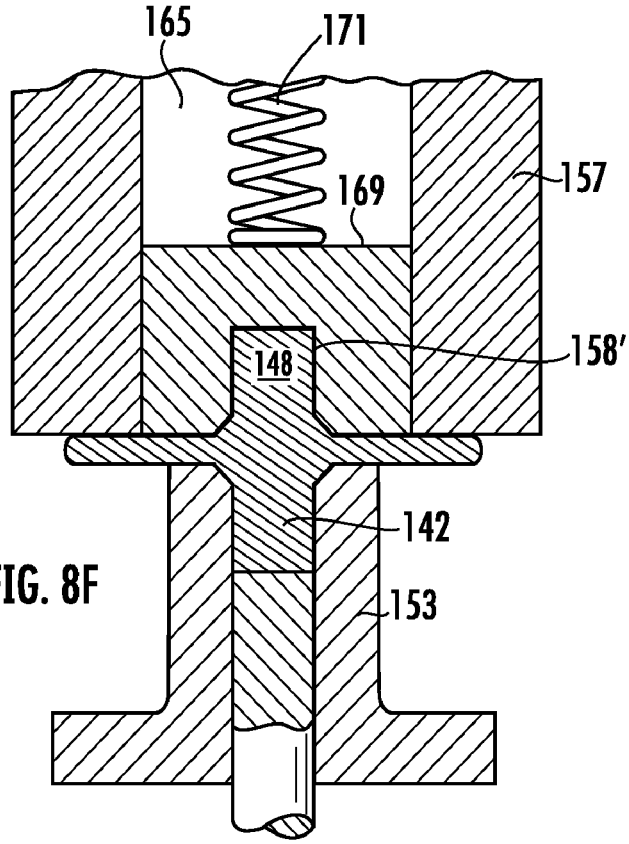

To complete raised walls 128 from flattened disc 126, FIG. 8*f* depicts holding first pole 142 in a secure manner, whether held in die 153 or another die (another die may be used if die 153 that is used for extruding first pole 142 is inadequate for securing first pole 142).

Figure 8G:
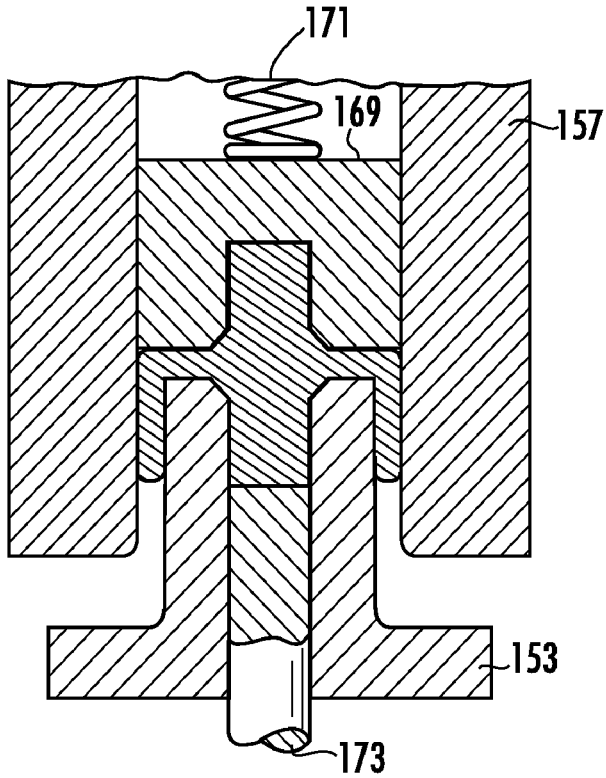
Figure 9A:
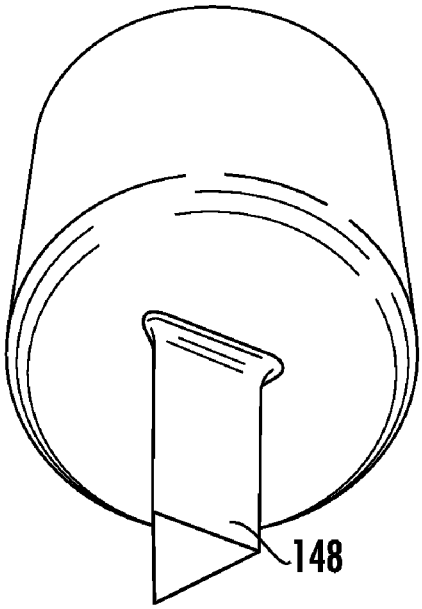
FIGS. 9*a*-9*d* depict various shapes of the center poles shown in FIGS. 2 and 7.
Figure 9B:
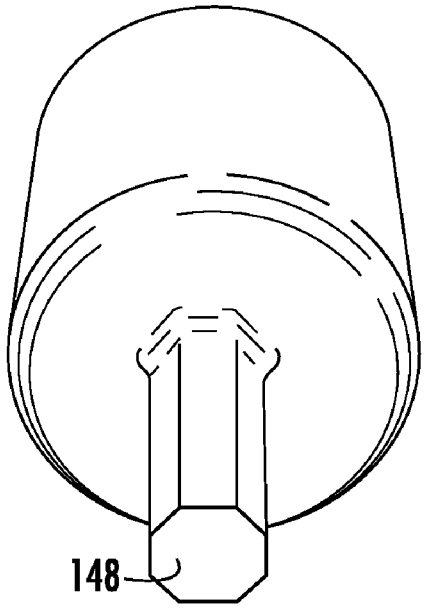
Figure 9C:
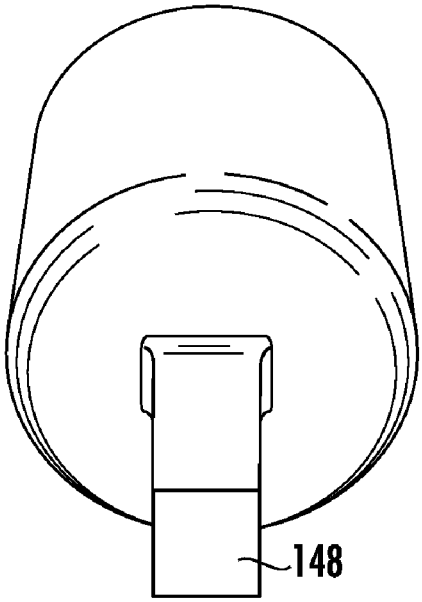
Figure 9D:
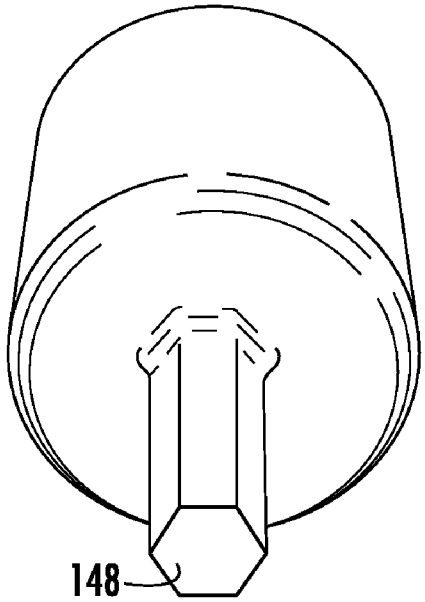

Die 157 having channel 165 and inner die 169 having orifice 158' (which has the same dimensions as orifice 158) are brought downwardly against flattened disc 126, resulting in raised wall 128 (see FIG. 8*g*). Since inner die 169 is spring loaded by spring 171, inner die 169 is pushed into channel 165, which permits in raised wall 128 being formed by being pressed between die 157 and die 153 (see FIG. 8*g*). Die 153 is removed from channel 165 and ejector 173 ejects material 106 from die 153.

It is important to note that second pole 148 and method for providing second pole 142 includes all of the advantages and limitations of first pole 142 and the method for providing first pole 142, including the grain line orientation, controlled thickness of second pole 148, and where second pole 148 is integrally connected with the rest of the solenoid housing 102 and where second pole 148 is extruded and formed from a single material 106. Additionally, annealing is conducted in between at least one of the steps shown in FIGS. 8*a*-8*g*.

Figure 10A:
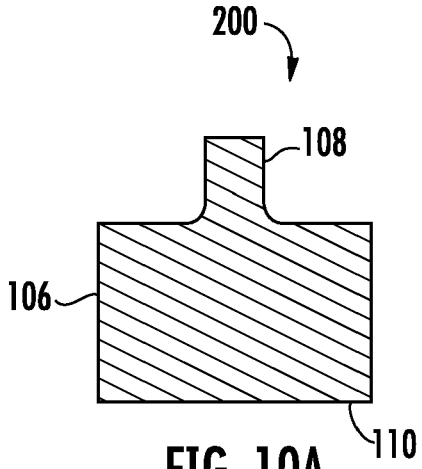
FIGS. 10*a*-10*f* depict an embodiment where a flange is placed on the raised wall in accordance with the method shown in FIG. 2.

As shown in FIGS. 10*a*-10*f*, another embodiment of housing 200 is depicted where flange 204 is attached to outer wall 206. As shown in FIG. 10*a*, material 106 including first end 108 and second 110 is provided in the same manner as described above and flange 204 is extruded from the same material as first end 108 and second end 110, wherein all of the components described herein under FIGS. 10*a*-10*f* are integrally connected and wherein annealing and/or stress reduction occurs between at least one of the steps illustrated in FIGS. 10*a*-10*f*.

Figure 10B:
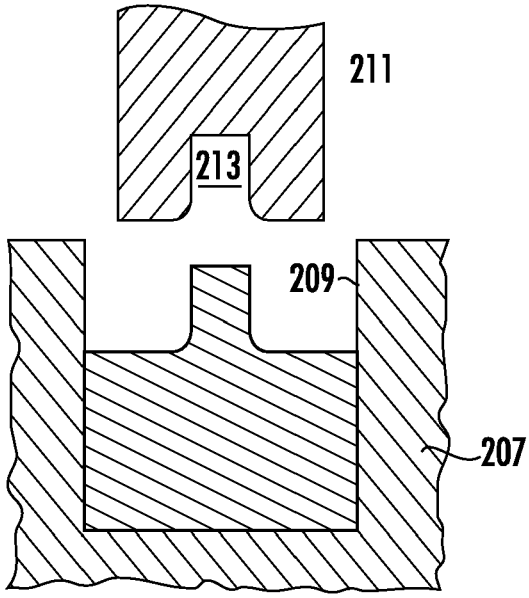
Figure 10C:
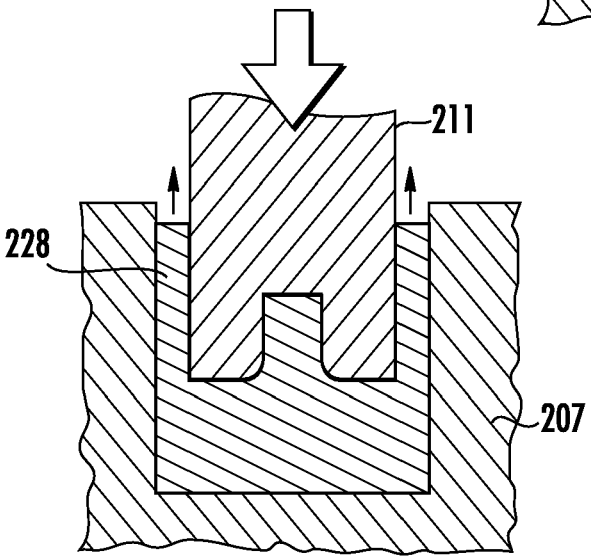

As shown in FIG. 10*b*, second end 110 is placed in die 207 and constrained by sidewall 209 of die 207. It is understood that sidewall 209 need not be in contact with second end 110 and that, in some embodiments, there is a clearance between second end 110 and die 207.

As punch 211 with orifice 213 is brought downward against material 106, raised wall 228 is formed by second end 110 being forced between die 207 and punch 211. Similar to raised wall 128 described above, raised wall 228 extends around an entire periphery of second end 110 and, in some embodiments, includes the same limitations as raised wall 128. See FIG. 10*c*. The size and shape of orifice 213 is indicative of the size and shape of first end 108 that will ultimately become pole 208 (see FIG. 10*f*).

In another embodiment, first end 106 need not be extruded before being placed in die 207 since punch 211 being brought down upon the material when placed within die 207 would push material into orifice 213 and form pole 208. In these embodiments, material is simply a cylinder when placed in die 207.

Figure 10D:
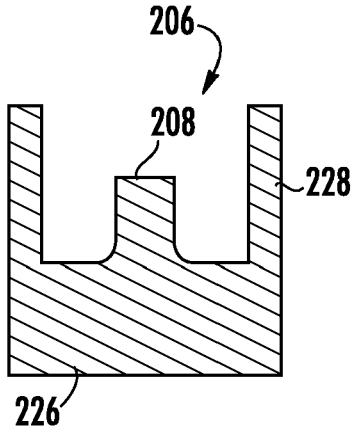

FIG. 10*d* depicts material 206 with pole 208, raised wall 228, and base 226 when removed from die 207.

Figure 10E:
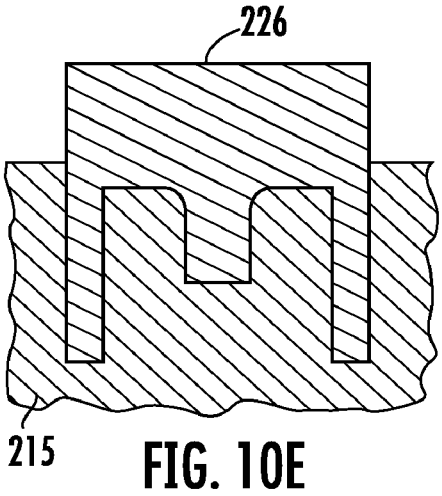
Figure 10F:
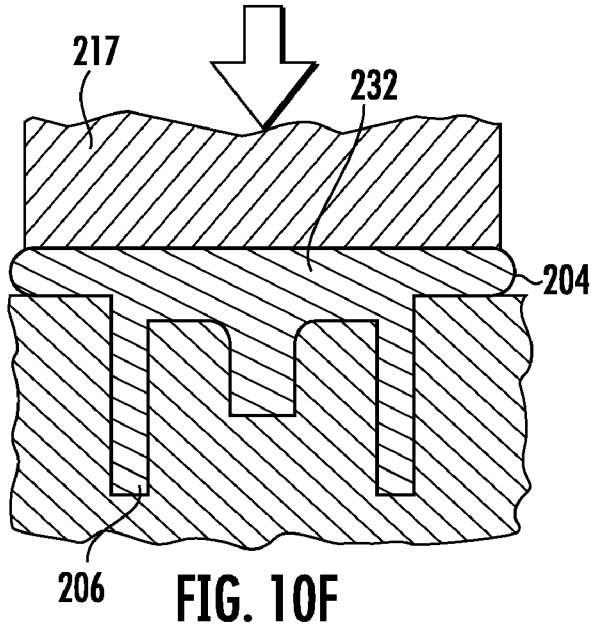

As shown in FIG. 10*e*, material 206 is inverted and placed within die 215 where pole 208 and raised wall 228 are secured and base 226 is exposed. As shown in FIG. 10*f*, punch 217 is brought down upon second end 110 to form flattened disc 232, wherein the outermost perimeter of disc 232 extends beyond a diameter of raised wall 228 to define flange 204, and wherein flange 204 is extruded and/or punched from the same material used to provide raised wall 228, base 226, and pole 208.

As shown in another embodiment, FIG. 11 a depicts housing 222 having hexagonal shaped raised wall 224. It is understood that although raised wall 224 is shaped as a hexagon, other embodiments have a wall shaped like an octagon, square, rectangle, triangle, or any polygon. The variations are as limitless as there are shapes. As shown in FIG. 2, method 20 includes the step of shaping 39 the raised wall such that it has a cross section selected from the group consisting of a square, rectangle, triangle, pentagon, hexagon, octagon, polygon, and combinations thereof.

Figure 11D:
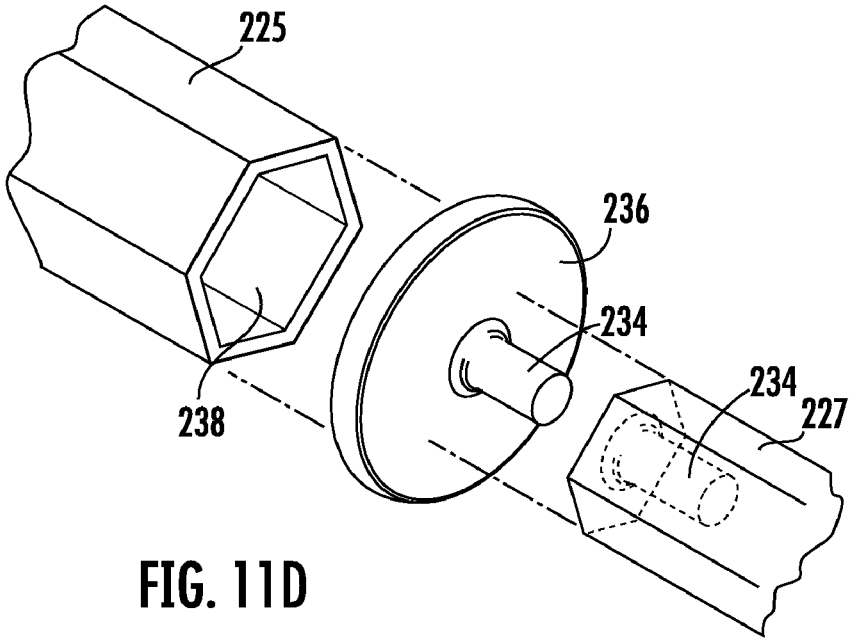
FIGS. 11*a*-11*d* depict an embodiment where the housing is shaped in accordance with the method shown in FIG. 2.
Figure 11A:
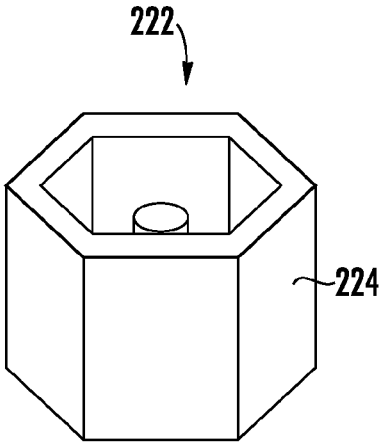

Consistent with all descriptions of previous embodiments, raised wall 224 being of various shapes is integrally connected with housing 22 and wherein all of the components described herein under FIGS. 11*a*-10*d* are integrally connected and wherein annealing and/or stress reduction occurs between at least one of the steps illustrated in FIGS. 11*a*-11*d*.

Figure 11B:
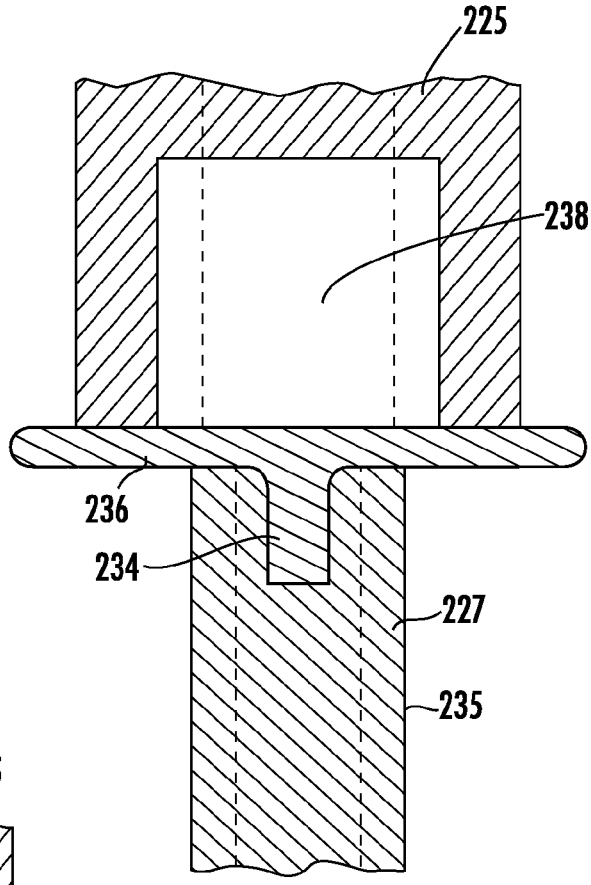

As shown in FIG. 11*b*, pole 234 and flattened disc 236 are provided as described under FIG. 4*a* and placed against punch 227 having a hexagonal shape around its perimeter 235. Die 225 with orifice 238 is brought down against disc 236, where punch 227 and disc 236 fit within orifice 238 and where orifice also has a hexagonal shape. This is more particularly depicted in FIGS. 11*c*-11*d*.

Figure 11C:
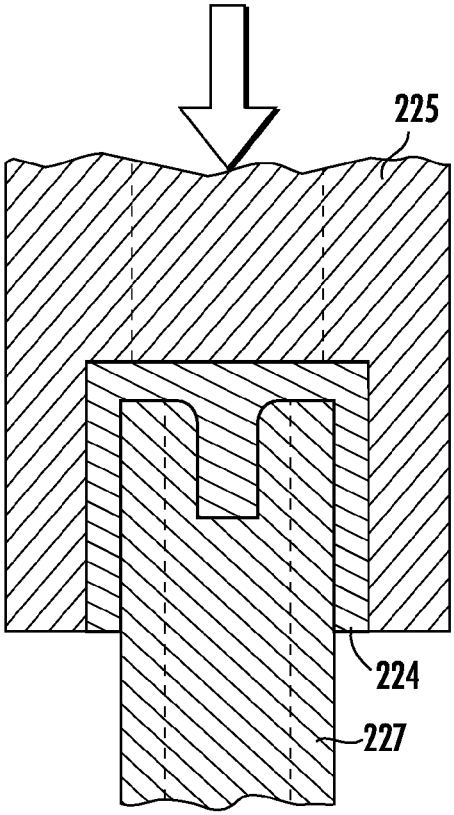

As shown in FIGS. 11*b*-11*d*, punch 227 includes orifice 239 for placing and securing pole 234.

What is claimed is:

1. A method of providing a solenoid housing, comprising the steps of:

providing a solid cylinder of malleable material having a first part and a second part;

reducing a diameter of the first part of the cylinder to be less than a diameter of the second part of the cylinder;

compressing the second part in an axial direction toward the first part, resulting in a solid, flattened disc approximately perpendicular to the solid, first part;

cold forging an entire outermost perimeter of the flattened disc in a direction toward the first part for defining a solid, raised wall;

extending the solid, raised wall to define a approximately annular recess having a depth; and wherein the first part, second part, and raised outermost perimeter are all integrally connected as a single piece.

2. The method according to claim 1, wherein the diameter of the first part is reduced by cold forging the first part of the cylinder through a die.

3. The method according to claim 1, further comprising the step of shaping the first part and an area defined by a junction of the first part and a side of the flattened disc facing the first part.

4. The method according to claim 1, further comprising the step of:

magnetically annealing the housing after at least one of the steps of:

providing a solid cylinder of malleable material having a first part and a second part;

reducing a diameter of the first part of the cylinder to be less than a diameter of the second part of the cylinder;

compressing the second part in an axial direction toward the first part, resulting in a flattened disc approximately perpendicular to the first part; and cold forging the entire outermost perimeter of the flattened disc in a direction toward the first part.

5. The method according to claim 1, further comprising the step of controlling a cross section of the flattened disc relative to a cross section of the entire raised outermost perimeter.

6. The method according to claim 5, further comprising the step of reducing a thickness of the raised outermost perimeter to be less than a thickness of the flattened disc.

7. The method according to claim 1, further comprising the step of orienting a plurality of grain lines of the flattened disc to be in a approximately radial direction extending outwardly from a general center of the flattened disc.

8. The method according to claim 1, further comprising the step of orienting a plurality of grain lines of the first part to be in a approximately axial direction extending along a length of the first part.

9. The method according to claim 1, further comprising the step of:

providing a third part of the solid cylinder of malleable material on a side of the second part opposite the first part; and reducing a diameter of the third part of the cylinder to be less than the diameter of the second part by cold forging the third part.

10. The method according to claim 9, further comprising the step of cold forging the third part of the cylinder through a die such that the third part has a cross sectional shape selected from the group consisting of a square, rectangle, triangle, pentagon, hexagon, octagon, polygon, and combinations thereof.

11. The method according to claim 9, further comprising the step of cold forging the third part of the cylinder through a die such that the diameter of the third part is different than the diameter of the first part.

12. The method according to claim 1, further comprising the step of providing a flange at an upper part of the raised outermost perimeter.

13. The method according to claim 1, further comprising the step of providing a flange at a lower part of the raised outermost perimeter.

14. The method according to claim 4, further comprising the step of cold forging the second part through a die such that the second part has a cross sectional shape selected from the group consisting of a square, rectangle, triangle, pentagon, hexagon, octagon, polygon, and combinations thereof.

15. A method of providing a solenoid housing, comprising the steps of:

providing a solid cylinder of malleable material having a first part and a second part;

reducing a diameter of the first part of the cylinder to be less than a diameter of the second part of the cylinder;

compressing the second part in an axial direction toward the first part, resulting in a solid, flattened disc with a first part side approximately facing towards the first part and a second part side approximately facing towards the second part;

cold forging an entire outermost perimeter of the flattened disc in a direction toward the first part for defining a solid, raised wall;

extending the solid, raised wall from the first part side in a direction approximately opposite the second part side;

controlling a cross section of the flattened disc strength relative to a cross section of the raised outermost perimeter;

orienting a plurality of grain lines of the flattened disc to be in a radial direction extending outwardly from a general center of the solid, flattened disc; and orienting a plurality of grain lines of the first part to be in an axial direction extending along a length of the solid, first part; and wherein the first part, second part, and raised outermost perimeter are all integrally connected as a single piece.

* * * * *